US010182648B1

(12) United States Patent
Lai

(10) Patent No.: US 10,182,648 B1
(45) Date of Patent: Jan. 22, 2019

(54) ADJUSTABLE TABLE

(71) Applicant: Ting-Yu Lai, Changhua (TW)

(72) Inventor: Ting-Yu Lai, Changhua (TW)

(73) Assignee: Kadeya Enterprise Co. Ltd., Changhua (TW)

( * ) Notice: Subject to any disclaimer, the term of this patent is extended or adjusted under 35 U.S.C. 154(b) by 0 days.

(21) Appl. No.: 15/892,233

(22) Filed: Feb. 8, 2018

(51) Int. Cl.
*A47B 9/20* (2006.01)
*A47B 13/08* (2006.01)

(52) U.S. Cl.
CPC ..... *A47B 13/081* (2013.01); *A47B 9/20* (2013.01); *A47B 2200/0042* (2013.01)

(58) Field of Classification Search
CPC ..... A47B 9/20; A47B 13/003; A47B 13/023; A47B 13/081; A47B 19/06; A47B 3/14; A47B 3/083; A47B 2200/0042; A47B 2200/0043
See application file for complete search history.

(56) References Cited

U.S. PATENT DOCUMENTS

| | | | | |
|---|---|---|---|---|
| 8,020,816 | B2 * | 9/2011 | Laitila | F16M 13/00 16/342 |
| 2003/0094123 | A1 * | 5/2003 | Ulmer | A47B 13/023 108/10 |
| 2006/0016945 | A1 * | 1/2006 | Taylor | A47B 19/06 248/188.5 |
| 2012/0073476 | A1 * | 3/2012 | Lai | A47B 13/00 108/2 |

FOREIGN PATENT DOCUMENTS

| | | |
|---|---|---|
| TW | M339956 | 9/2008 |

* cited by examiner

*Primary Examiner* — Daniel J Rohrhoff
(74) *Attorney, Agent, or Firm* — Che-Yang Chen; Law Offices of Scott Warmuth

(57) ABSTRACT

An adjustable table may comprise a base, an adjusting unit and a tabletop, and the adjusting unit further has a locating seat, a sliding seat, a spring, a first shaft, a connecting rod and an operating rod. The locating seat has a first top plate, and each of two lateral edges of the first top plate is vertically connected to a first side plate. The first shaft is configured to simultaneously couple with the two first side plates, which significantly improves the stableness of the adjustable table when the tabletop bearing weight.

4 Claims, 12 Drawing Sheets

ADJUSTABLE TABLE

FIELD OF THE INVENTION

The present invention relates to an adjustable table and more particularly to a table with an angle adjustable tabletop.

BACKGROUND OF THE INVENTION

Referring to FIGS. 9 to 11 or Taiwan Patent No. M339956, a conventional adjustable table (40) comprises a leg portion (41), a locating seat (42), a pivot base (43), a spring (44), a lever (45) and a tabletop (46). An outer tube (411) upwardly extends from a central portion of the leg portion (41), and am inner tube (412) is configured to be inserted into the outer tube (411) and have vertical movements relative to the outer tube (411). Moreover, a first pivot hole (413) is adapted to penetrate through an upper portion of the inner tube (412). The locating seat (42) and the pivot base (43) are respectively formed in an inverted-U shape, and two second pivot holes (421) respectively penetrate through two lateral surfaces of the locating seat (42) at corresponding positions while two third pivot holes (431) respectively penetrate through two lateral surfaces of the pivot base (43) at corresponding positions. After the locating seat (42) connected to the upper portion of the inner tube (412), the locating seat (42) is configured to be mounted on the pivot base (43) to align the third pivot holes (431) with the second pivot holes (421) and the first pivot hole (413), and a shaft is adapted to penetrate through the first pivot hole (413), the second pivot holes (421) and the third pivot holes (431) to secure the pivot base (43) with the locating seat (42) and the inner tube (412). Furthermore, a locating hole (422) and an arc-shaped guiding groove (423) are respectively formed at one of the lateral surfaces of the locating seat (42), and a row of blocking holes having a larger diameter than the guiding groove (423) are sequentially formed on the guiding groove (423). The lateral surface of the pivot base (43), which is located on the same side of the guiding groove (423), is connected to a connecting portion (432), and two lateral surface of the connecting portion (432) which are respectively close to and away from the pivot bae (43) respectively comprise a hollow rib (434) and an opening (433), and a side groove communicated with the opening (433) is formed at a rear surface of the connecting portion (432) which is perpendicular to the two lateral surface. Additionally, the pivot base (43) is configured to be secured on the tabletop (46). The lever (45) has a hook-shaped pulling portion (451) and a head end (453) respectively formed at two ends thereof, and a bent extending portion (432) is formed between the pulling portion (451) and the head end (453). The tabletop (46) has a through hole (461) located at a side of a bottom surface thereof, and the head end (453) is adapted to pass through the through hole (461) to extend along the bottom surface of the tabletop (46). The spring (44) is adapted to be coupled in the side groove of the connecting portion (432), and the head end (453) is configured to pass through the spring (44). Also, a bolt (47) located adjacent to the head end (453) is adapted to penetrate through the lever (45) to couple with the spring (44) such that when the lever (45) is pulled, the bolt (47) is configured to compress the spring (44).

When the tabletop (46) is horizontal, the hollow rib (434) of the pivot base (43) is configured to align with a lowest one of the blocking holes (424), and the protruding head end (453) is adapted to engage with the blocking hole (424), thereby securing the tabletop (46) at a horizontal position through the spring (44). When the use angle of the tabletop (46) needs to be changed, a user can pull the pulling portion (451) of the lever (45) outwardly to move the head end (453) inwardly (as shown in FIG. 12), and the spring (44) is adapted to be compressed by the bolt (47) such that the head end (453) can be detached from the blocking hole (424), and then the tabletop (46) can be flipped with an angle. Meanwhile, the pivot base (43) is pivotally rotated about the guiding groove (423), and when the lever (45) is released, the spring (44) is configured to move the lever (45) back to an initial position, thereby engaging the head end (453) in a different blocking hole (424). With the fore-mentioned structures, a user can complete adjusting the angle of the tabletop (46) with one hand. On the contrary, when the tabletop (46) needs to be folded, a user can pull out the lever (45) and flip the tabletop downward, and thereafter a user can align the hollow rib (434) of the pivot base (43) with the locating hole (422) of the locating seat (42), and then release the lever (45) such that the head end (453) is adapted to engage in the locating hole (422), thereby securing the tabletop (46) in a folded position.

However, the conventional adjustable table is disadvantageous because: (i) the lever (45) only can engage on a single lateral side of the pivot base (43), and when another lateral side of the pivot base (43) is pressed, the pivot base (43) is configured to misalign with the locating seat (42), leading to the unstableness of the tabletop (46); and (ii) it needs a lot of efforts for a user to adjust the angle of the tabletop (46) in a manner of pulling the lever (45). Therefore, there remains a need for a new and improved design for an adjustable table to overcome the problems presented above.

SUMMARY OF THE INVENTION

The present invention provides an adjustable table which comprises a base, an adjusting unit and a tabletop, and the adjusting unit further has a locating seat, a sliding seat, a spring, a first shaft, a connecting rod and a bent operating rod. The base has a supporting rod extending upwardly from a central top surface of the base, and a top end of the supporting rod is configured to connect to the locating seat. The locating seat has a first top plate, and each of two lateral edges of the first top plate is vertically connected to a first side plate. Two arc-shaped elongated grooves respectively penetrate through the two first side plates at corresponding positions, and each of the elongated grooves has a plurality of positioning holes and a locating hole, and the positioning holes are adapted to laterally penetrate through an upper portion of the elongated groove while the locating hole is configured to laterally penetrate through a lower end of the elongated groove. Moreover, a diameter of each of the positioning holes and a diameter of the locating hole are respectively larger than the elongated groove. The sliding seat has a second top plate, and each of two lateral edges of the second top plate is vertically connected to a second side plate. The sliding seat is configured to cover the locating seat, and a second shaft is adapted to penetrate through and pivotally secure the sliding seat and the locating seat together. Furthermore, the tabletop is configured to be mounted on the second top plate. Each of the two second side plates has a through hole, and the two through holes are located at corresponding positions. One of the second side plates is connected to a bracket at an outer surface thereof, and the bracket is located at a position horizontally aligned with the through hole.

The first shaft, the connecting rod and the operating rod are configured to be connected sequentially and to pivotally connect to the sliding seat and the locating seat through the bracket. The first shaft has two neck portions which have a smaller diameter to separate a first section, a second section and a third section of the first shaft. Also, a locating bolt is adapted to penetrate through the third section. Through the first section, the first shaft is configured to sequentially pass through the spring, the through hole and the elongated groove close to the bracket, and the elongated groove and the through hole away from the bracket to connect to a blocking member which is adapted to enable the first shaft to have limited horizontal movement relative to the locating seat and the sliding seat, thereby preventing the first shaft from detaching from the locating seat and the sliding seat. The spring is configured to bear against the sliding seat and the locating bolt at two ends thereof, and without external force, the spring is adapted to enable the first section and the second section to respectively engage with two corresponding positioning holes on the two first side plates, thereby securing positions of the sliding seat and the tabletop. The operating rod comprises a first rod body and a second rod body, and the first rod body is pivotally coupled in the bracket to enable the second rod body to protrude from a lateral end of the bracket. The connecting rod pivotally connected between the first rod body and the third section of the first shaft is adapted to transfer momentum from the operating rod to the first shaft when a user applies force on the operating rod.

Comparing with conventional adjustable table, the present invention is advantageous because: (i) the first shaft is configured to simultaneously couple with the two first side plates, which significantly improves the stableness of the adjustable table when the tabletop bearing weight; and (ii) it is a labor-saving manner that the first shaft is driven through the first rod body and the connecting rod when the second rod body is pulled upwardly.

DETAILED DESCRIPTION OF THE INVENTION

Figure 1:
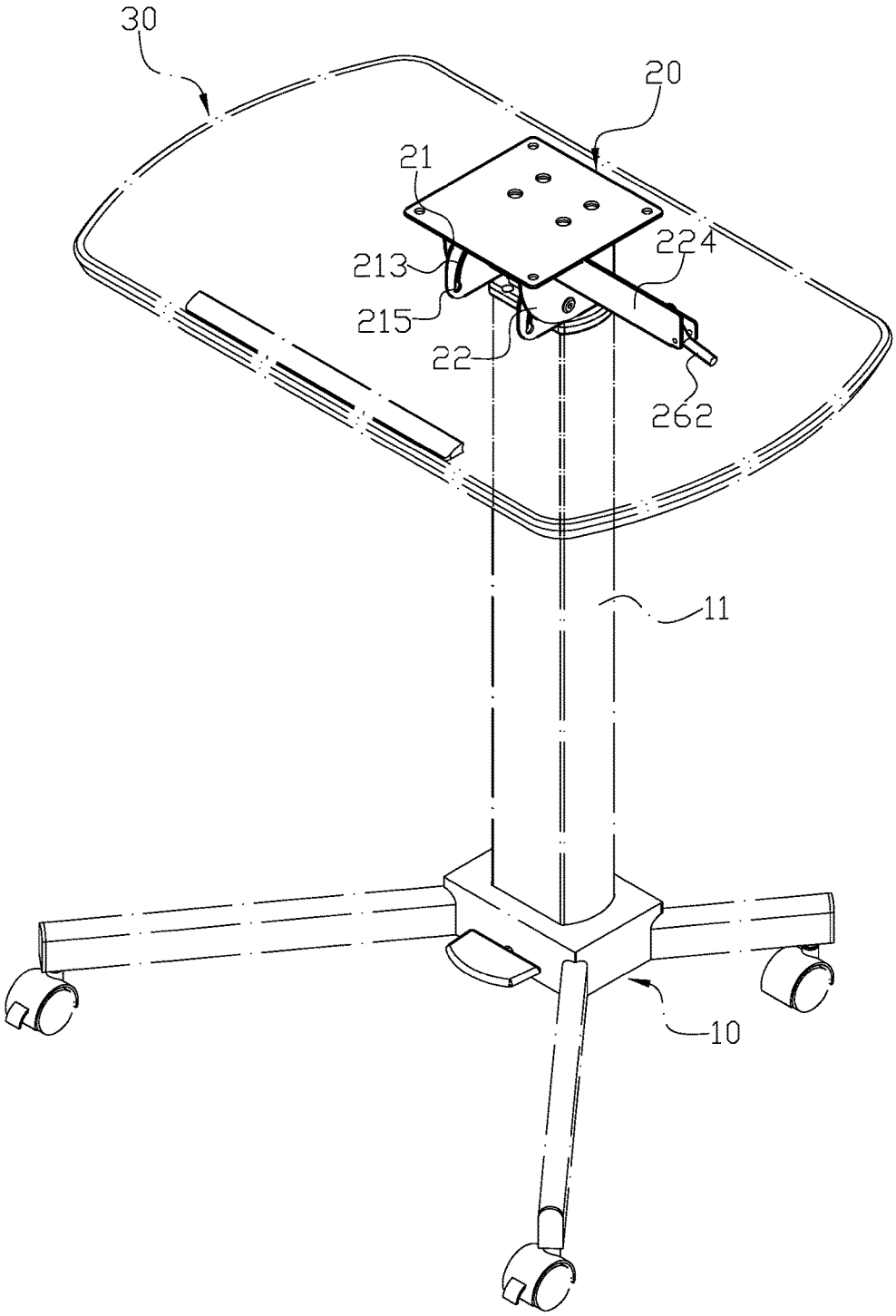
FIG. 1 is a three-dimensional assembly view of an adjustable table in the present invention.
Figure 2:
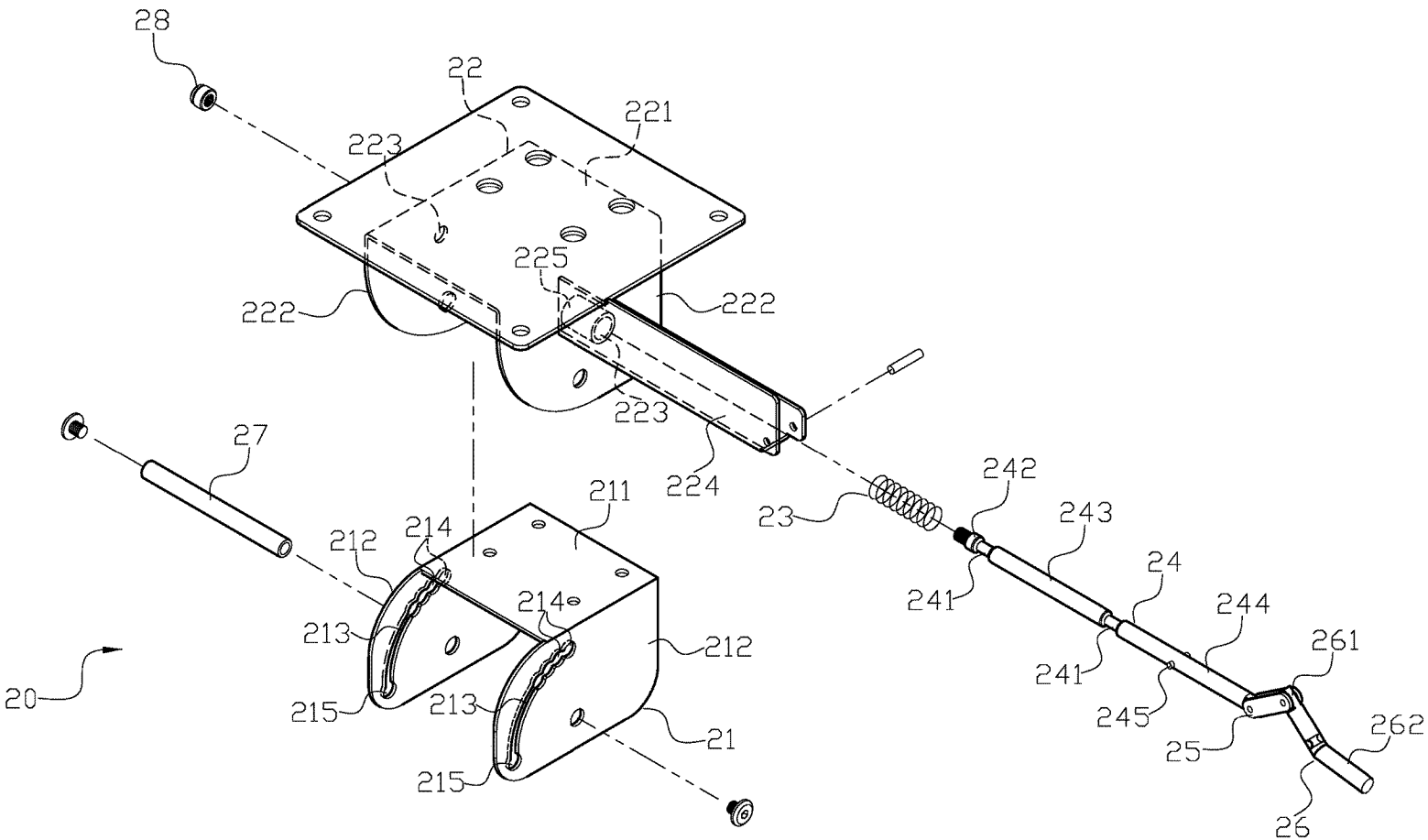
FIG. 2 is a three-dimensional exploded view of an adjusting unit of the adjustable table in the present invention.
Figure 3:
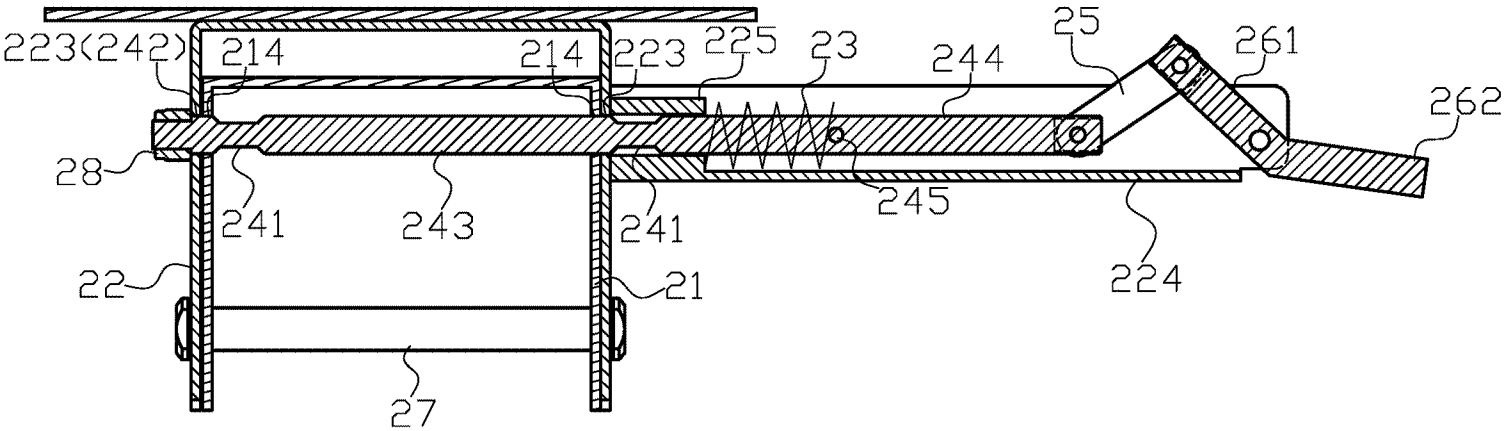
FIG. 3 is a sectional assembly view of the adjusting unit of the adjustable table in the present invention.

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

In order to further understand the goal, characteristics and effect of the present invention, a number of embodiments along with the drawings are illustrated as following:

Referring to FIGS. 1 to 4, the present invention provides an adjustable table which comprises a base (10), an adjusting unit (20) and a tabletop (30), and the adjusting unit (20) further has a locating seat (21), a sliding seat (22), a spring (23), a first shaft (24), a connecting rod (25) and a bent operating rod (26). The base (10) has a supporting rod (11) extending upwardly from a central top surface of the base (10), and a top end of the supporting rod (11) is configured to connect to the locating seat (21). The locating seat (21) has a first top plate (211), and each of two lateral edges of the first top plate (211) is vertically connected to a first side plate (212). Two arc-shaped elongated grooves (213) respectively penetrate through the two first side plates (212) at corresponding positions, and each of the elongated grooves (213) has a plurality of positioning holes (214) and a locating hole (215), and the positioning holes (214) are adapted to laterally penetrate through an upper portion of the elongated groove (213) while the locating hole (215) is configured to laterally penetrate through a lower end of the elongated groove (213). Moreover, a diameter of each of the positioning holes (214) and a diameter of the locating hole (215) are respectively larger than the elongated groove (213). The sliding seat (22) has a second top plate (221), and each of two lateral edges of the second top plate (221) is vertically connected to a second side plate (222). The sliding seat (22) is configured to cover the locating seat (21), and a second shaft (27) is adapted to penetrate through and pivotally secure the sliding seat (22) and the locating seat (21) together. Furthermore, the tabletop (30) is configured to be mounted on the second top plate (221). Each of the two second side plates (222) has a through hole (223), and the two through holes (223) are located at corresponding positions. One of the second side plates (222) is connected to a bracket (224) at an outer surface thereof, and the bracket (224) is located at a position horizontally aligned with the through hole (223).

The first shaft (24), the connecting rod (25) and the operating rod (26) are configured to be connected sequentially and to pivotally connect to the sliding seat (22) and the locating seat (21) through the bracket (224). The first shaft (24) has two neck portions (241) which have a smaller diameter to separate a first section (242), a second section (243) and a third section (244) of the first shaft (24). Also, a locating bolt (245) is adapted to penetrate through the third section (244). Through the first section (242), the first shaft (24) is configured to sequentially pass through the spring (23), the through hole (223) and the elongated groove (213) close to the bracket (224), and the elongated groove (213) and the through hole (223) away from the bracket (224) to connect to a blocking member (28) which is adapted to enable the first shaft (24) to have limited horizontal movement relative to the locating seat (21) and the sliding seat (22), thereby preventing the first shaft (24) from detaching from the locating seat (21) and the sliding seat (22). The spring (23) is configured to bear against the sliding seat (22) and the locating bolt (245) at two ends thereof, and without external force, the spring (23) is adapted to enable the first section (242) and the second section (243) to respectively engage with two corresponding positioning holes (214) on the two first side plates (212), thereby securing positions of the sliding seat (22) and the tabletop (30). The operating rod (26) comprises a first rod body (261) and a second rod body (262), and the first rod body (261) is pivotally coupled in the bracket (224) to enable the second rod body (262) to protrude from a lateral end of the bracket (224). The connecting rod (25) pivotally connected between the first rod body (261) and the third section (244) of the first shaft (24) is adapted to transfer momentum from the operating rod (26) to the first shaft (24) when a user applies force on the operating rod (26).

In one embodiment, the supporting rod (11) of the base (10) is a telescopic rod.

In another embodiment, the positioning holes (214) on the first side plate (212) are arranged continuously, and two adjacent positioning holes (214) are partially overlapped.

In still another embodiment, a protruding tube (225) is formed on the outer surface of the second side plate (222) of the sliding seat (22) at a position corresponding to the bracket (224) for being abutted against by the spring (23).

Figure 4:
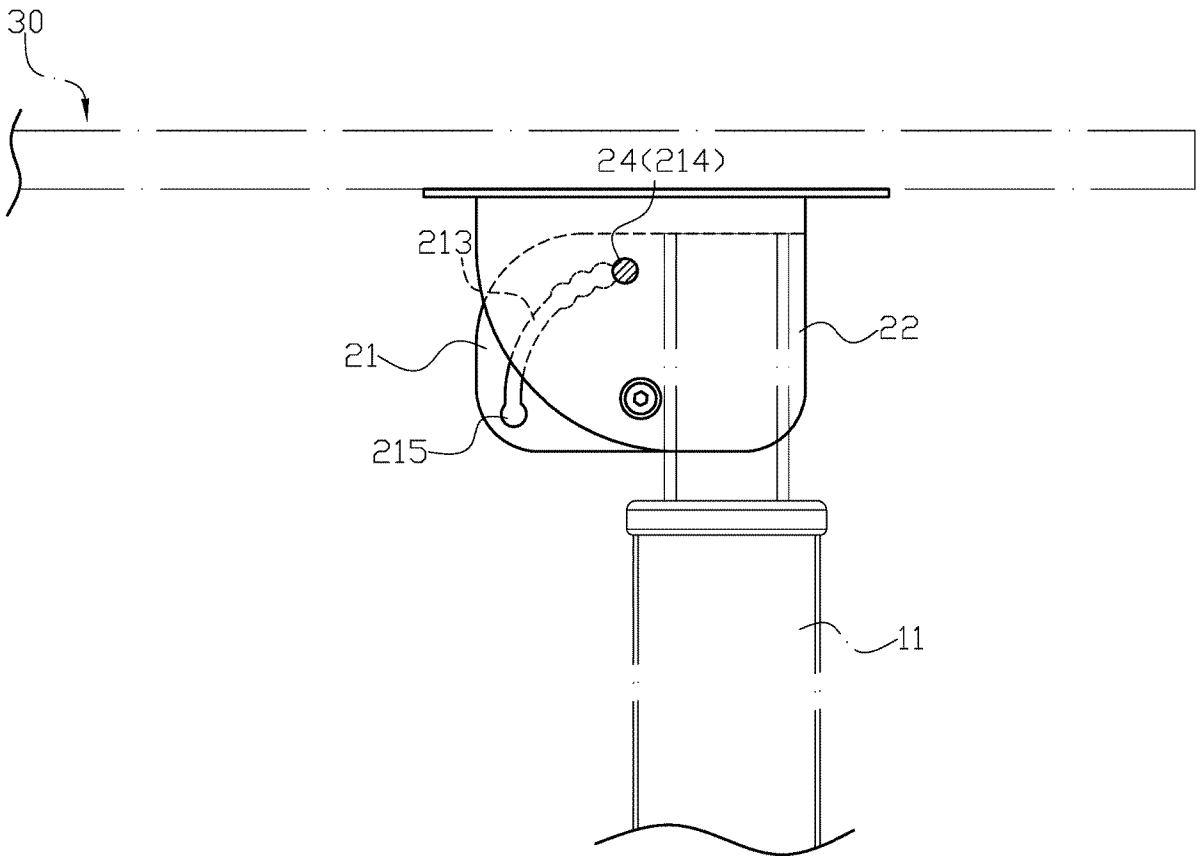
FIG. 4 is a schematic view illustrating a tabletop of the adjustable table is at a horizontal position.
Figure 5:
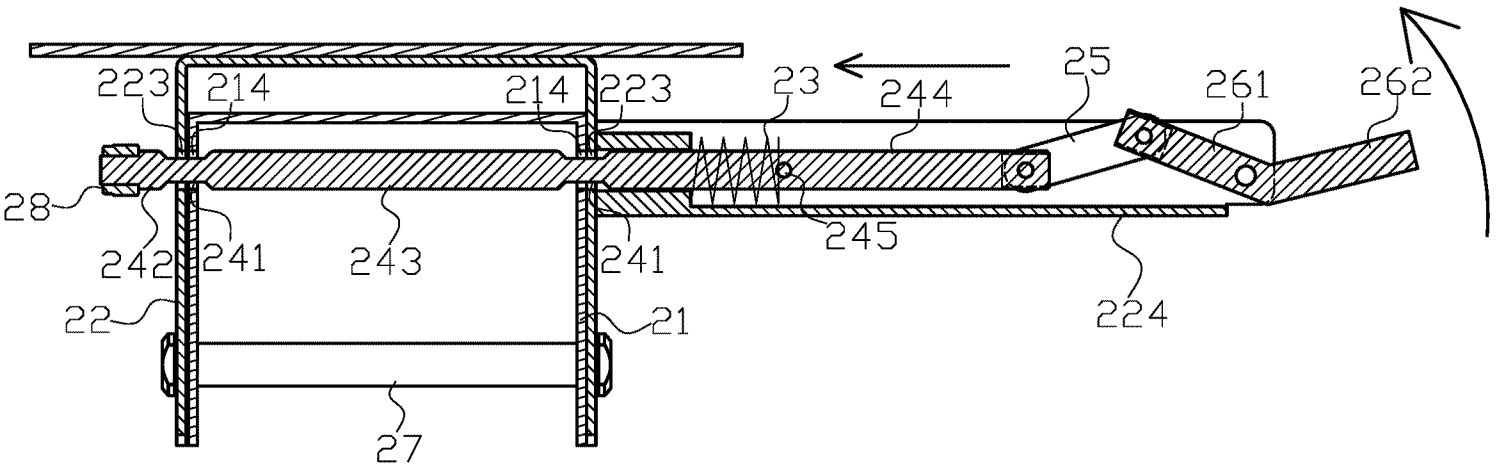
FIG. 5 is a schematic view illustrating an operating rod of the adjustable table is pulled up to move a first shaft horizontally.
Figure 6:
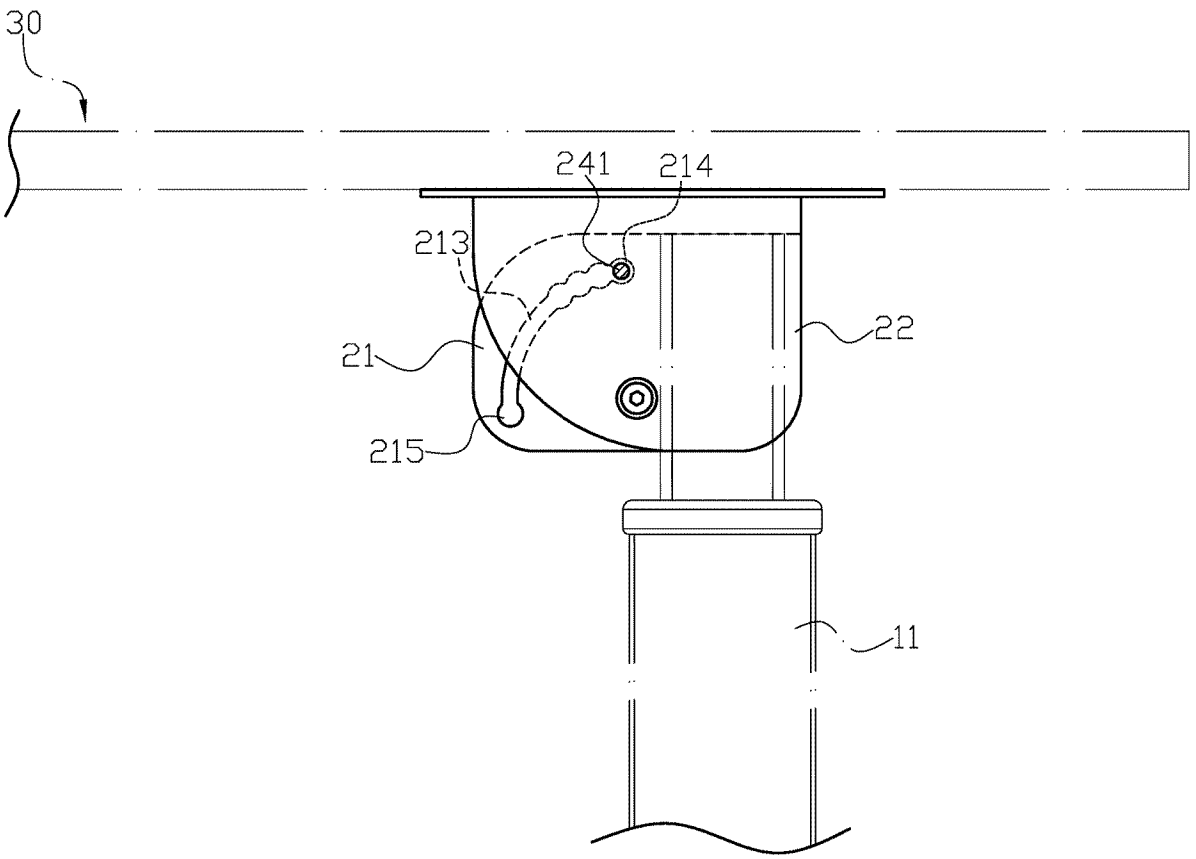
FIG. 6 is a schematic view illustrating a neck portion of the first shaft of the adjustable table is positioned in one of positioning holes.
Figure 7:
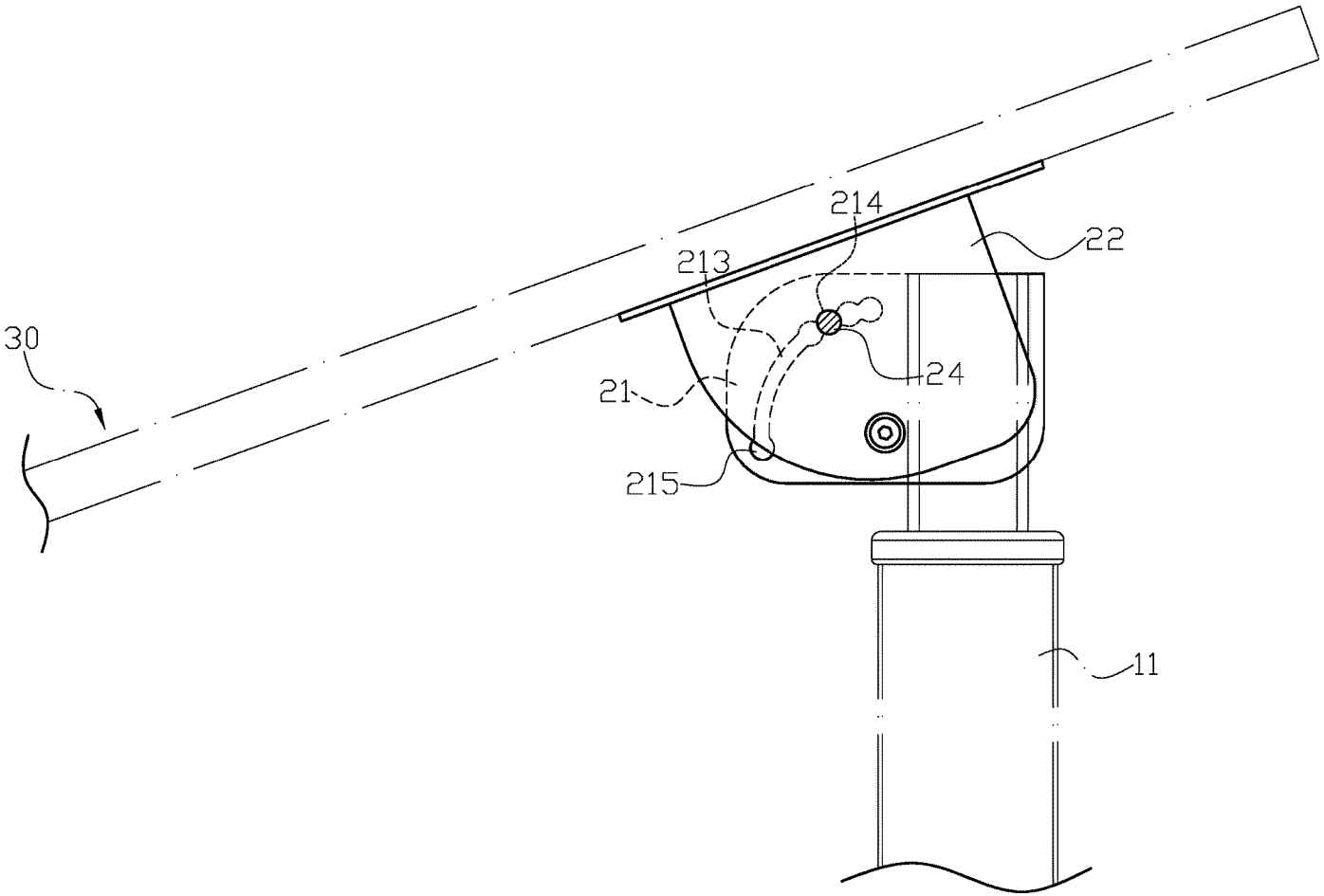
FIG. 7 is a schematic view illustrating the tabletop is secured at a tilted position for use.
Figure 8:
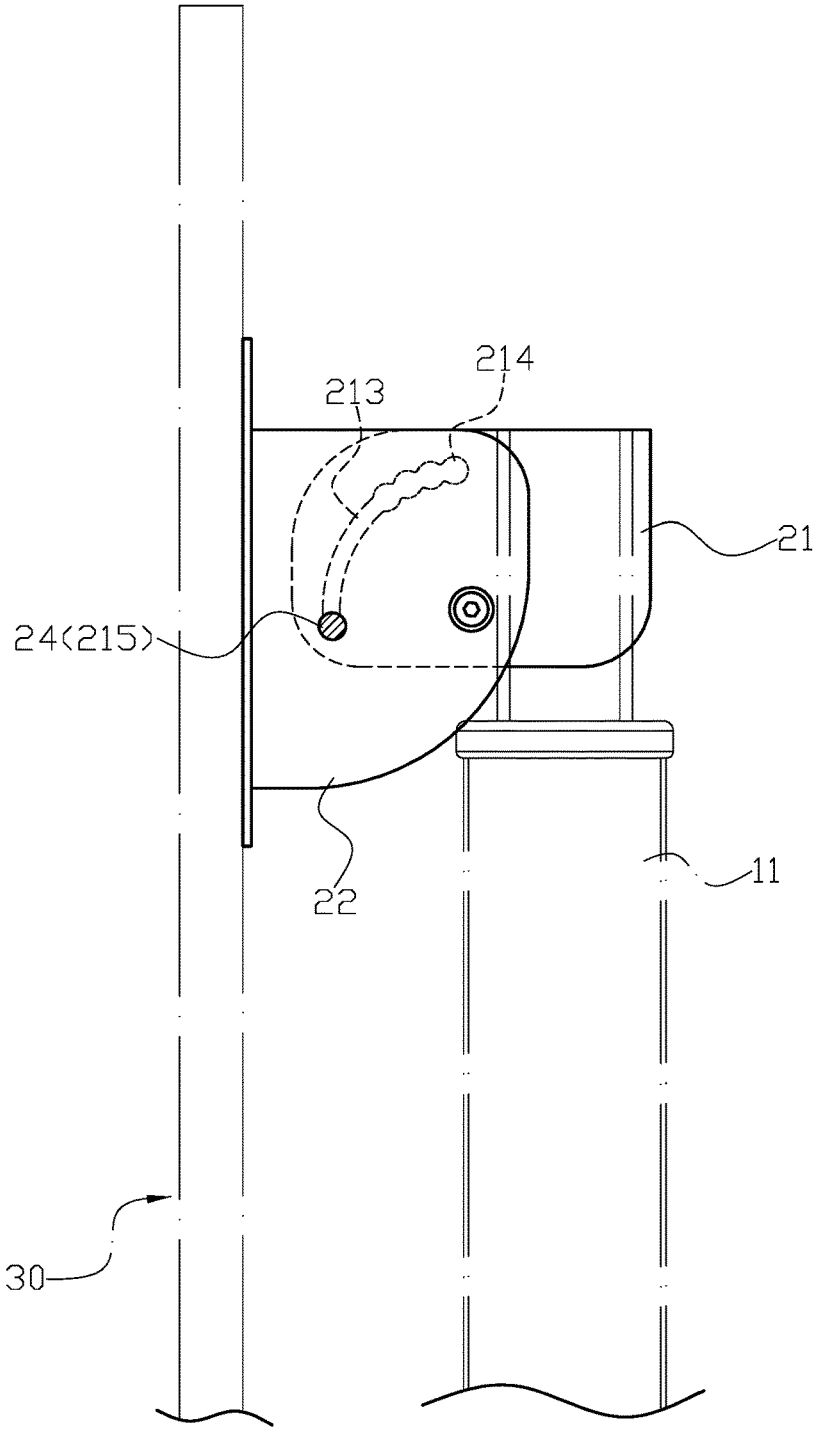
FIG. 8 is a schematic view illustrating the tabletop is at a folded position.
Figure 9:
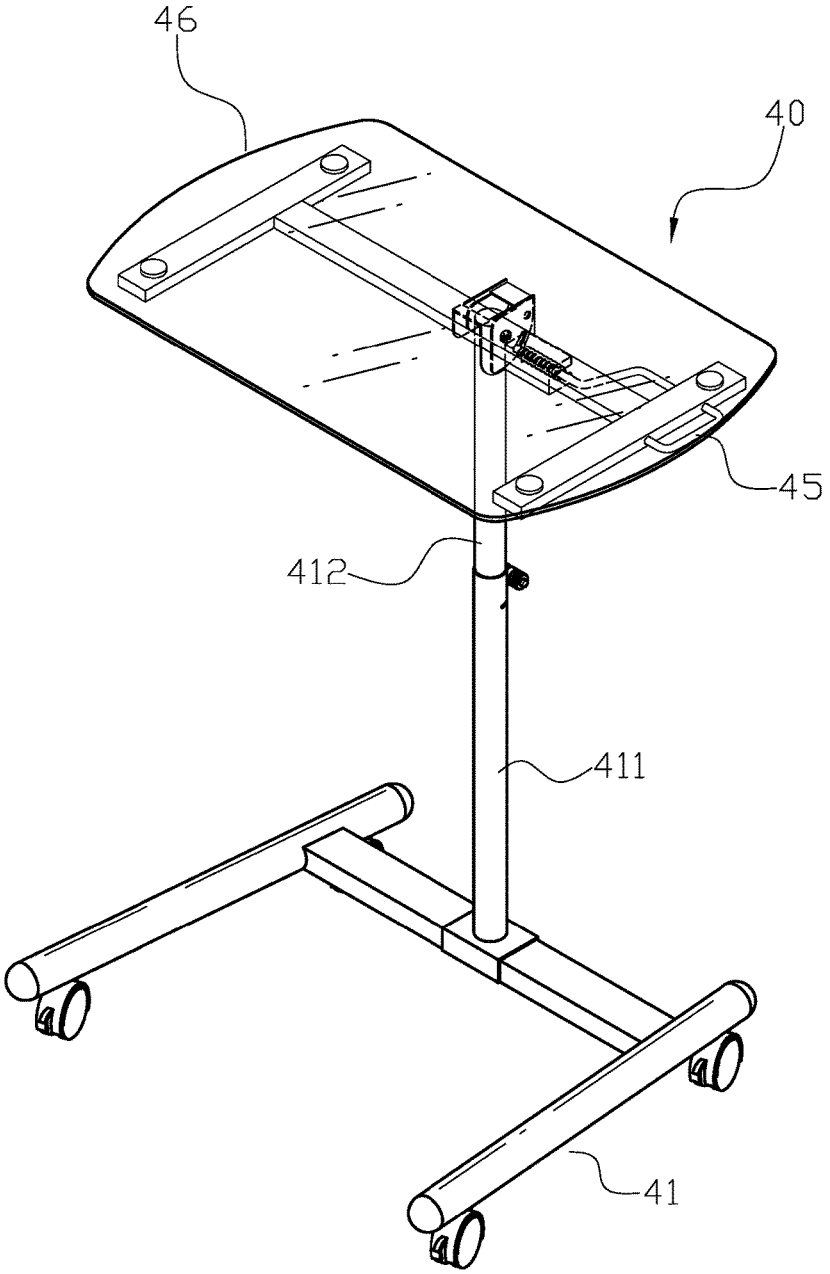
FIG. 9 PRIOR ART
FIG. 9 is a prior art.
Figure 10:
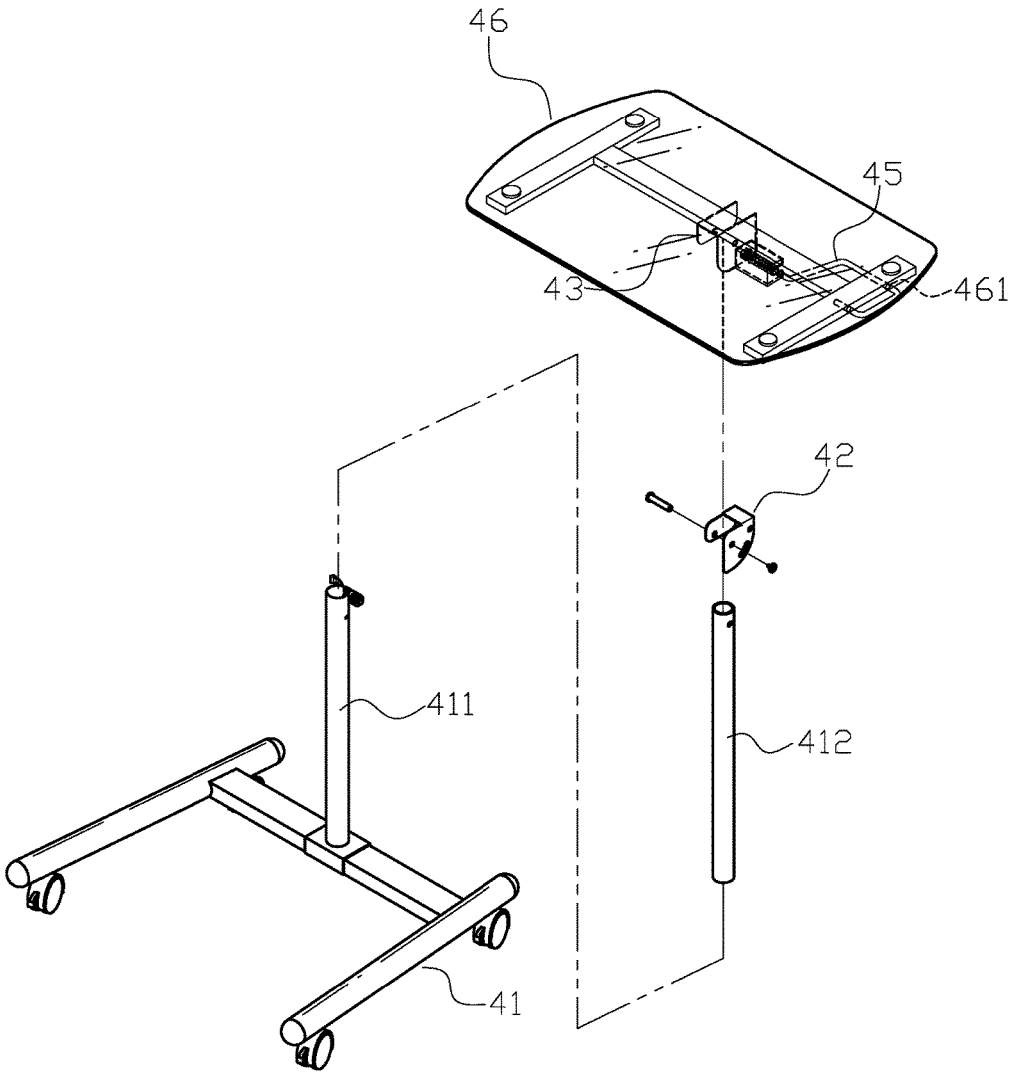
FIG. 10 PRIOR ART
FIG. 10 is a prior art.
Figure 11:
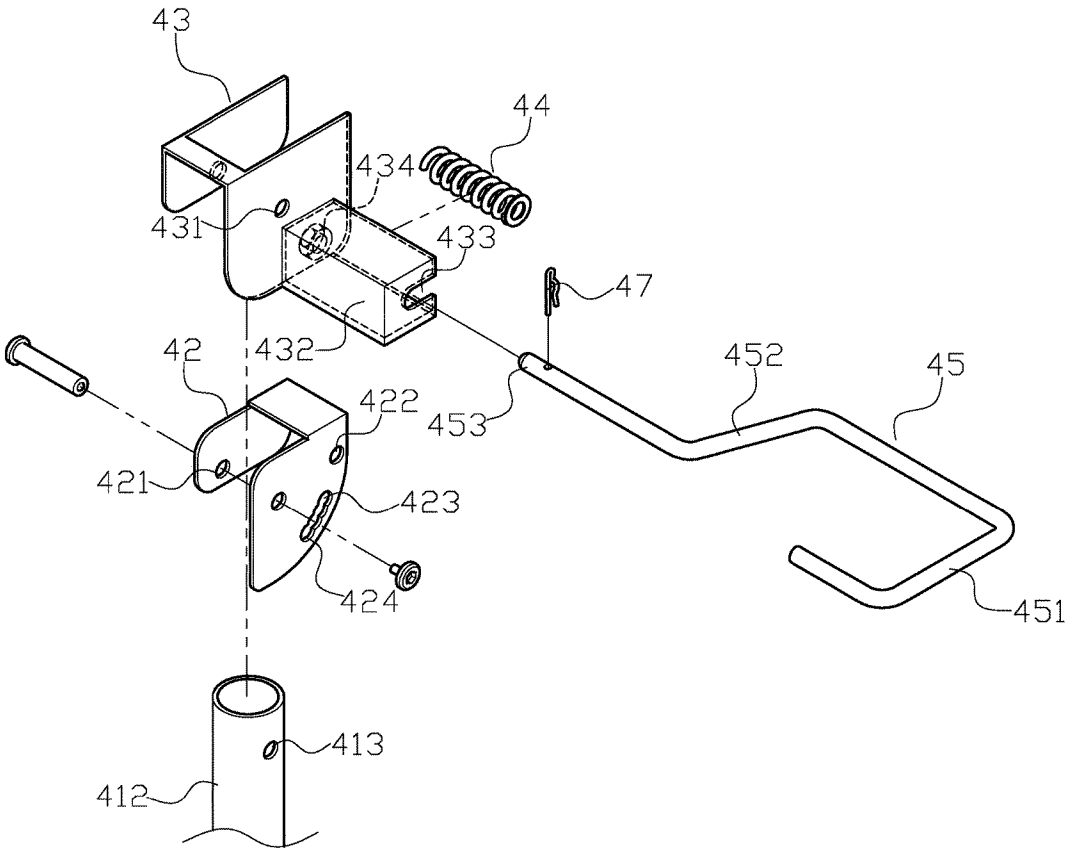
FIG. 11 PRIOR ART
FIG. 11 is a prior art.
Figure 12:
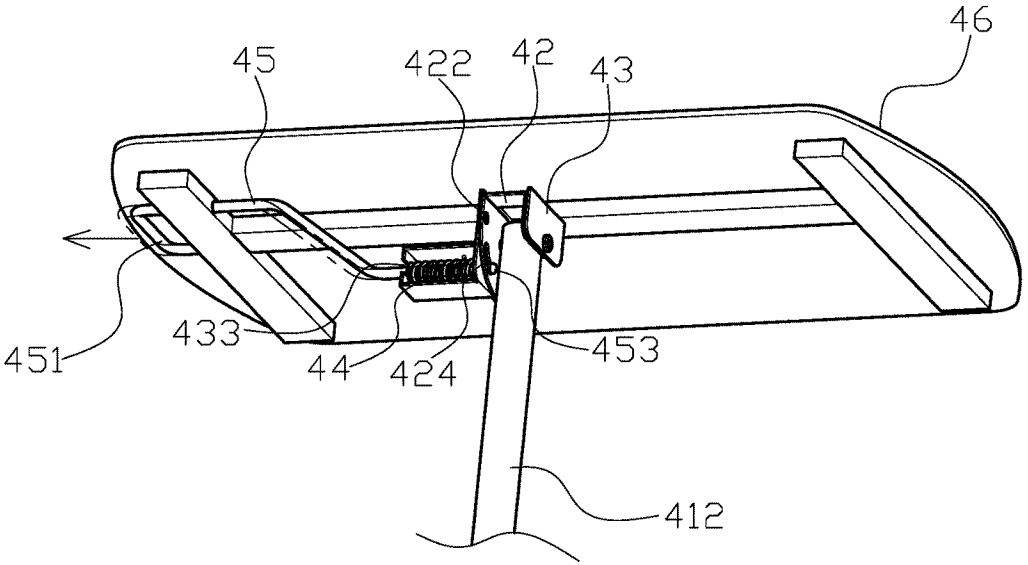
FIG. 12 PRIOR ART
FIG. 12 is a prior art.

In actual application, a user can adjust the angle of the tabletop (30) by pulling the second rod body (262) upwardly, and the first rod body (261) and the connecting rod (25) are driven to move the first shaft (24) horizontally (as shown in FIG. 5) such that the first section (242) and the second section (243) are respectively disengaged from the two original-engaged positioning holes (214) on the two first side plates (212) while the two neck portions (241) are respectively moved into the two positioning holes (214) (as shown in FIG. 6). Since each of the neck portions (241) has the diameter smaller than the elongated groove (213), the first shaft (24) is configured to move along instead of being blocked by the elongated grooves (213) when the sliding seat (22) located on the locating seat (21) is moved to pivotally turn the tabletop (30). The tabletop (30) can be tilted with different angles for use, and when the operating rod (26) is released, the first shaft (24) is configured to be pushed back by the spring (23) to selectively engage with two upper positioning holes (214), two corresponding positioning holes (214) between the upper positioning holes (214) and the locating holes (215) or the two locating holes (215), thereby enabling the tabletop (30) to be secured at a horizontal position (as shown in FIG. 4), a specific angle of tilted position (as shown in FIG. 7) or at a folded position (as shown in FIG. 8).

Comparing with conventional adjustable table, the present invention is advantageous because: (i) the first shaft (24) is configured to simultaneously couple with the two first side plates (212), which significantly improves the stableness of the adjustable table when the tabletop (30) bearing weight; and (ii) it is a labor-saving manner that the first shaft (24) is driven through the first rod body (261) and the connecting rod (25) when the second rod body (262) is pulled upwardly.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. An adjustable table comprising a base, an adjusting unit and a tabletop, and the adjusting unit having a locating seat, a sliding seat, a spring, a first shaft, a connecting rod and a bent operating rod;

wherein the base has a supporting rod extending upwardly from a central top surface of the base, and a top end of the supporting rod is configured to connect to the locating seat;

wherein the locating seat has a first top plate and two first side plates; the two first side plates are arranged in face-to-face, and two arc-shaped elongated grooves respectively penetrate through the two first side plates at corresponding positions; each of the elongated grooves has a plurality of positioning holes and a locating hole, wherein the positioning holes are adapted to laterally penetrate through an upper portion of the elongated groove respectively while the locating hole is configured to laterally penetrate through a lower end of the elongated groove; a diameter of each of the positioning holes and a diameter of the locating hole are larger than the elongated groove;

wherein the sliding seat having a second top plate and two second side plates is configured to cover the locating seat, and the two second side plates are arranged in face-to-face; a second shaft is adapted to penetrate through and pivotally secure the sliding seat and the locating seat together; the tabletop is configured to be mounted on the second top plate; each of the two second side plates has a through hole, and the two through holes are located at corresponding positions; one of the second side plates is connected to a bracket at an outer surface thereof, and the bracket is located at a position horizontally aligned with the through hole; the first shaft, the connecting rod and the operating rod are configured to be connected sequentially and to pivotally connect to the sliding seat and the locating seat through the bracket;

wherein the first shaft has two neck portions which have a smaller diameter to separate a first section, a second section and a third section of the first shaft, and a locating bolt is adapted to penetrate through the third section; through the first section, the first shaft is configured to sequentially pass through the spring, the through hole and the elongated groove close to the bracket, and the elongated groove and the through hole away from the bracket to connect to a blocking member which is adapted to enable the first shaft to have limited horizontal movement relative to the locating seat and the sliding seat, thereby preventing the first shaft from detaching from the locating seat and the sliding seat; the spring is configured to bear against the sliding seat and the locating bolt at two ends thereof, and without external force, the spring is adapted to enable the first section and the second section to respectively engage with two corresponding positioning holes on the two first side plates, thereby securing positions of the sliding seat and the tabletop; and wherein the operating rod comprises a first rod body and a second rod body, and the first rod body is pivotally coupled in the bracket to enable the second rod body to protrude from a lateral end of the bracket; the connecting rod pivotally connected between the first rod body and the third section of the first shaft is adapted to transfer momentum from the operating rod to the first shaft when a user applies force on the operating rod.

2. The adjustable table of claim 1, wherein the supporting rod of the base is a telescopic rod.

3. The adjustable table of claim 1, wherein the positioning holes on the first side plate are arranged continuously, and two adjacent positioning holes are partially overlapped.

4. The adjustable table of claim 1, wherein a protruding tube is formed on the outer surface of the second side plate of the sliding seat at a position corresponding to the bracket for being abutted against by the spring.

* * * * *